United States Patent [19]

Parrent

[11] 4,271,610

[45] Jun. 9, 1981

[54] ADHESIVELY ATTACHABLE ROTATABLE SOLE PLATE FOR SHOES

[76] Inventor: Buddy R. E. Parrent, 7207 N. Chicago, Portland, Oreg. 97203

[21] Appl. No.: 56,867

[22] Filed: Jul. 12, 1979

[51] Int. Cl.[3] ..... A43B 23/00

[52] U.S. Cl. ..... 36/136

[58] Field of Search ..... 36/113, 136, 19.5, 130

[56] References Cited

U.S. PATENT DOCUMENTS

| | | | |
|---|---|---|---|
| 2,671,971 | 3/1954 | Garretson | 36/113 |
| 3,081,562 | 3/1963 | Oakley | 36/113 |
| 3,195,244 | 7/1965 | Whitcas | 36/130 |
| 3,693,269 | 9/1972 | Guarrera | 36/19.5 |

*Primary Examiner*—Patrick D. Lawson

*Attorney, Agent, or Firm*—Chernoff & Vilhauer

[57] ABSTRACT

A pivot plate for attachment to the sole of a shoe comprises paired cylindrical discs which are rotatably fastened to one another in vertical adjacency, and which have antifriction pads located on their inwardly facing surfaces so that said discs rotate freely relative to one another even when subjected to an axial load. A double-backed membrane having a protective cover on one of its sides is attached to the outer surface of one of the discs so that the pivot can be attached to an existing shoe quickly and easily merely by removing the cover and pressing it in place.

7 Claims, 6 Drawing Figures

FIG. 1
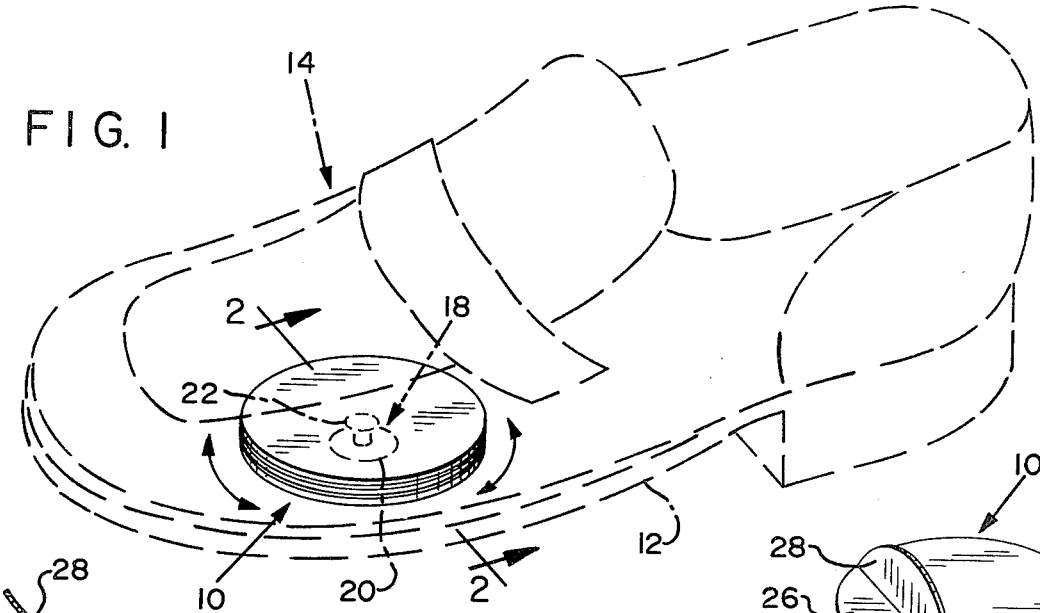
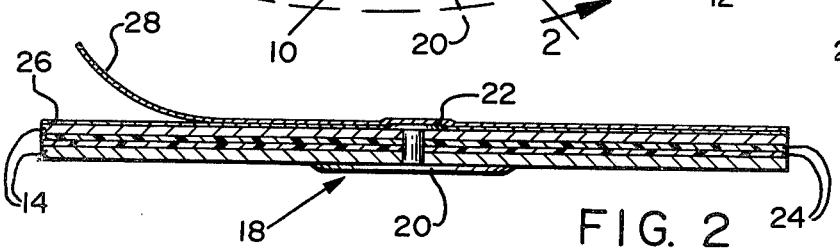
FIG. 2
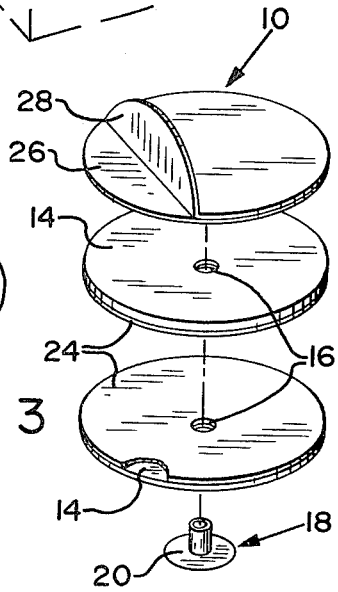
FIG. 3
FIG. 4
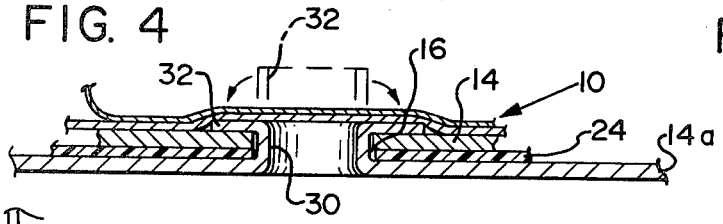
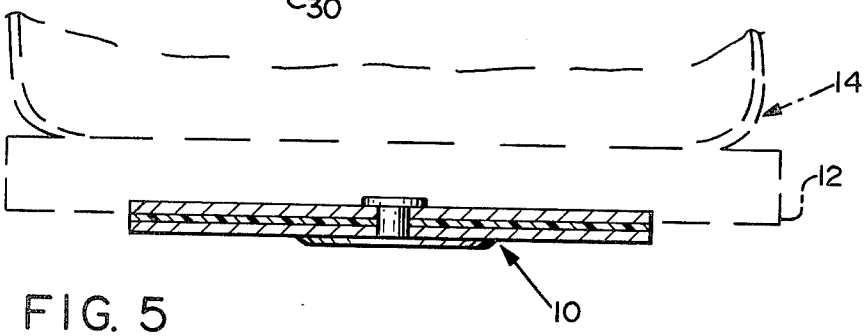
FIG. 5
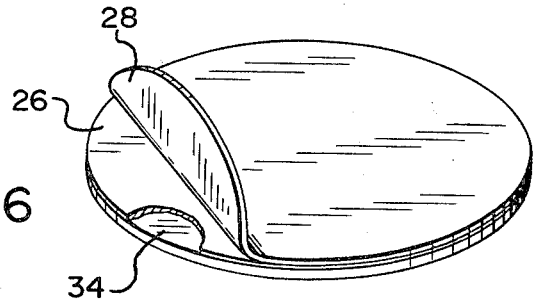
FIG. 6

ADHESIVELY ATTACHABLE ROTATABLE SOLE PLATE FOR SHOES

BACKGROUND AND SUMMARY OF THE INVENTION

This invention relates to a rotatable sole plate for attachment to a shoe for assisting the pivoting of the shoe when dancing, and particularly to such a sole plate having an adhesive backing material for easy attachment to an existing shoe.

In many types of dancing, particularly disco dancing which is in vogue today, the dancer must be able to freely rotate on the soles of his shoes. While good quality leather soles facilitate this maneuver to a limited extent, in order to enable the dancer to make multiple turns without the necessity of undue atheletic ability, it is desirable to provide sole plates which effectively reduce the friction between the shoes and the dance floor.

This has been done in the past in several manners. The most simple is the direct attachment of metal plates, such as are used for tap dancing, to the soles of the shoes. However, heretofore this has been done by the use of nails which necessitates that the plates be attached by a person which a certain amount of expertise, such as a shoemaker. Otherwise if the improper type of nails are used, they will either be too long, and protrude into the feet of the user, or wil be too short and not effectively hold the taps in place. Accordingly, the cost of attaching plates of this type to an existing pair of shoes is quite expensive due to the semi-skilled labor involved.

Other types of rotatable plates, having paired rotatable discs, one of which is attachable to the shoes, and the other of which rests on the floor, are well known in the prior art. However, the prior art devices of this kind have attachment problems which are even more severe than with metal taps, thus limiting their acceptance and commercial success as an item for attachment to existing shoes. In addition, the devices of this type previously known have utilized a complex bearing system between the opposed plates thereby causing the pivot device itself to be far too expensive and subject to malfunction to be acceptble for the intended use.

The subject invention on the other hand, provides simple, inexpensive friction means which interfaces paired cylindrical discs to provide the aforesaid operation. In addition the uppermost disc is provided with a thin double-backed adhesive membrane which is attached on one of its sides to the upper disc and is covered on its other side by a removable covering. Accordingly, by removing the covering from the adhesive membrane the device can readily be attached to the sole of the shoe.

In one embodiment, the antifriction means comprises low-friction pads which are attached to the inwardly facing faces of the respective discs and the discs are attached to one another rotatably by a rivet which is secured through central openings located in the discs.

In another embodiment, a single thin cylindrical plate of low friction material is attached to the adhesive membrane so that the plate can be attached directly to the sole of the shoe by removing the piece of cover material and pressing it in place.

Accordingly, it is a principal objective of the present invention to provide a sole plate for attachment to the sole of a shoe to facilitate rotation of the shoe, wherein the sole plate can be attached to the shoe in an inexpensive manner without the necessity of skilled labor.

It is a further object of the present invention to provide such a sole plate wherein the means for reducing friction between the shoe and the floor is of simple low cost construction for ease of operation and long life.

The foregoing objectives, features and advantages of the present invention will be more readily understood upon consideration of the following detailed description of the invention taken in conjunction with the accompanying drawings.

BRIEF DESCRIPTION OF THE DRAWINGS

FIG. 1 is a pictorial view of the sole plate of the present invention attached to a shoe which is shown in phantom.

FIG. 2 is a sectional view taken along the line 2—2 of FIG. 1.

FIG. 3 is an exploded pictorial view of the sole plate of FIG. 1.

FIG. 4 is a fragmentary sectional view showing another embodiment of the invention.

FIG. 5 is a sectional view showing yet another embodiment of the invention.

FIG. 6 is a pictorial view showing still another embodiment of the invention.

DETAILED DESCRIPTION OF THE INVENTION

Referring to FIG. 1 of the drawings, the pivot 10 of the present invention is attached to the sole 12 of a shoe 14 to assist pivoting of the shoe relative to the surface upon which it rests, such as when dancing. The pivot generally comprises plate means having transverse dimensions which are less than the dimensions of the sole 12. Antifriction means associated with the plate means provides a relatively low coefficient of friction between the sole of the shoe and the floor and thus supplies the operative aspects of the invention. Adhesive attachment means are also associated with the plate means for easy attaching of the plate means to the shoe.

In the embodiment shown in FIGS. 1, 2 and 3 of the drawings, the plate means comprises a pair of thin cylindrical discs 14 which are located vertically adjacent to one another. The discs both have central openings 16 extending through them and fastener means, such as a rivet 18, fits through the openings to secure the discs to one another. The rivet has a large head 20 with a tapered periphery so that it does not mar the floor upon which the device is used. The rivet is secured by flaring its upper extremity to form a head 22 in a manner such that the plates rotate freely relative to one another and yet do not wobble.

In this embodiment of the invention the antifriction means includes pads 24 of low-friction material, such as a self-lubricating plastic, which are adhered to the inwardly facing faces of both of the discs 14. Accordingly, the discs rotate freely with respect to one another even when they are being subjected to an axial load. The pads can either be formed independently from the discs 14 and attached to them by suitable means, or else fabricated in place on the discs such as by spraying.

The adhesive attachment means comprises a membrane 26 of double-backed adhesive. One side of the membrane is adhered to the upper one of the discs 14, referring to FIGS. 2 and 3, and the other side of the membrane is covered by a removable protective cover 28. Thus, by removing the cover the pivot can be easily attached to the sole of the shoe merely by pressing it in place.

An alternate form of the fastener means is illustrated in FIG. 4. In this embodiment the upper disc 14 is the same as described above and contains a central opening 16. However, the lower disc 14a, rather than merely having an opening, has an upstanding tublar stud 30 with the same diameter as opening 16 formed in its medial portion by means such as stamping. The stud 30 then is inserted through the opening in the upper disc, as shown by the phantom lines in FIG. 4, and folded downwardly in the direction of the arrows over the top of the upper disc 14. As a result, the stud 30 serves the same purpose as the rivet 18 in the prior embodiment. In this embodiment a single pad 24 of antifriction material is shown.

In another embodiment of the invention, shown in FIG. 5, rather than being attached to the outer surface of the sole, a recess, conforming to the shape of the upper disc 14, is formed in the sole and the upper disc is then secured within this recess. This embodiment is used when the pivot is attached to the shoe by the manufacturer rather than being available for later attachment in the aftermarket.

The last embodiment of the invention, shown in FIG. 6, integrates the plate means and pivot means into a single, thin, cylindrical plate 34 of low-friction material, such as the type used for the pads 24 above. The membrane 26 and cover material 28 are then attached directly to one side of the plate 34 so that the plate can be adhered to the sole of the shoe if desired.

In all of the embodiments of the invention, the pivot serves to greatly reduce the effective friction between the sole of the shoe and the floor so that the shoe can be easily rotated when dancing. In addition, in all of the embodiments of the invention, the device is easily attachable to an existing shoe without the need for any special materials or skilled labor.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A pivot for attachment to the sole of a shoe for assisting in pivoting the shoe relative to a floor while dancing, comprising:

(a) Plate means having transverse dimensions which are less than the dimensions of the sole of the shoe;

(b) Antifriction means associated with said plate means for providing a relatively low coefficient of friction between said shoe and the floor to facilitate rotation of the shoe relative to the floor, wherein said plate means and said antifriction means are integral and comprise a thin, cylindrical plate formed from a low-friction material; and (c) Adhesive attachment means associated with said plate means for adhesively attaching said plate means to the shoe.

2. The pivot of claim 1 wherein said adhesive attachment means comprises a membrane of double-backed adhesive, one side of said membrane being attached to said plate means and the other side of said membrane being removably covered by a protective cover.

3. A pivot for attachment to the sole of a shoe for assisting in pivoting the shoe relative to the floor while dancing, comprising:

(a) Plate means having transverse dimensions which are less than the dimensions of the sole of the shoe, said plate means comprising aligned, paired, cylindrical discs secured in rotational adjacency to one another by fastener means;

(b) Antifriction means associated with said plate means for providing a relatively low coefficient of friction between said shoe and the floor; and (c) Adhesive attachment means associated with said plate means for adhesively attaching said plate means to the shoe, said adhesive attachment means comprising a membrane of double-backed adhesive, one side of the membrane being attached to said plate means and the other side of said membrane being removably covered by a protective cover.

4. The pivot of claim 3 wherein said discs have central openings located therein and said fastener means includes a rivet which passes through said openings.

5. The pivot of claim 3 wherein an upper one of said discs has a central opening located therein and said fastener means includes an upstanding tubular stud located in the other of said discs and having a diameter arranged for registry within said central opening, said stud extending through said central opening and being flared outwardly on the opposite side of said one of said discs.

6. The pivot of claim 4 or 5 wherein said antifriction means includes paired pads of low-friction material one being attached to each of said discs on the side thereof facing the opposed disc.

7. The pivot of claim 6 wherein a central cavity, having the same transverse dimensions as said disc is located in the sole of said shoe, and said upper one of said discs is substantially contained within said recess.

* * * * *